United States Patent [19]

Nobbs

[11] 4,220,335

[45] Sep. 2, 1980

[54] GAMES RACKETS

[75] Inventor: John W. Nobbs, Ewhurst, England

[73] Assignee: Alloway Trust Limited, Douglas, Isle of Man

[21] Appl. No.: 972,719

[22] Filed: Dec. 26, 1978

[30] Foreign Application Priority Data

Dec. 31, 1977 [GB] United Kingdom ..... 54404/77
May 31, 1978 [GB] United Kingdom ..... 25549/78

[51] Int. Cl.[3] ..... A63B 51/12
[52] U.S. Cl. ..... 273/73 R; 273/73 C
[58] Field of Search ..... 273/73 R, 73 J, 73 H, 273/73 D, 73 C; 29/433

[56] References Cited

U.S. PATENT DOCUMENTS 3,545,756 12/1970 Nash ..... 273/73
3,625,512 12/1971 Latham et al. ..... 273/73 C
3,664,668 5/1972 Held ..... 273/73 C
3,805,366 4/1974 Vaughn ..... 29/433

FOREIGN PATENT DOCUMENTS 13732 7/1933 Australia ..... 273/73 C
650598 1/1929 France ..... 273/73 C

*Primary Examiner*—John D. Yasko
*Attorney, Agent, or Firm*—Cushman, Darby & Cushman

[57] ABSTRACT

A games racket comprising a shaft and a head formed by a continuous frame section having a plurality of apertures adapted to receive the strings of the racket and a protective bumper strip attached to the outer face of the frame section, the bumper strip comprising an inner face which conforms generally to the shape of at least a substantial part of the width of the outer face of the frame section and being formed with a plurality of apertures aligned with the apertures in the frame section to receive the strings of the racket therethrough.

18 Claims, 5 Drawing Figures

GAMES RACKETS

The invention is concerned with a games racket of the type having a handle, a shaft and a strung head such as for instance a tennis racket, a squash racket or a racket ball racket.

In many racket games, and in particular in racket ball and squash rackets, the racket may come into conect with the floor, a wall of the court or with an opponent causing damage either to the racket or to the object with which is comes into contact. There is therefore a need to protect the end of the head frame of the racket and to soften the effect of the impact of this part of the frame against another object. In recent years metal tennis rackets and racket ball rackets have become increasingly popular and in the future it is envisaged that metal squash rackets will also become acceptable, thereby increasing the desirability of and need for some form of protection on the outer end of the metal frame.

It has been known for many years to provide a resilient plastics channel which complements the shape of the frame of the racket and which can be clipped into position by a spring action onto the end of the racket head or which can be attached in position by some form of binding. While this type of protective clip is useful in certain circumstances it has the disadvantage that it is liable to come away from the racket under any severe impact and can in itself be a danger to a player when it comes away from the racket.

It is also known from U.S. Pat. No. 3,805,366 to provide a metal tennis racket frame with a plastics grommet strip having a plurality of integral grommets positioned around the outer face of the frame with the grommets projecting through holes in the frame. The racket strings are then passed through the grommets which protect the strings from chafing and damage by contact with the metal racket frame. The structure disclosed in this prior U.S. Specification provides suitable protection for the racket strings but is not concerned with or directed to the solution of the problem by protecting the outer face of the end of the racket frame.

In its broadest aspect the present invention has as its object the provision of a protective strip which complements the outer surface of the end of the racket head frame so as to protect the outer face of the frame and which is attachable to the frame securely by the racket strings which pass through both the racket frame and the protective strip.

The present invention therefore provides a games racket comprising a shaft and a head formed by a continuous frame section having a plurality of apertures adapted to receive the strings of the racket and a protective bumper strip attached to the outer face of the frame section, the bumper strip comprising an inner face which conforms generally to the shape of at least a substantial part of the width of the outer face of the frame section and being formed with a plurality of apertures aligned with the apertures in the frame section to receive the strings of the racket therethrough.

The protective bumper strip may be formed with a plurality of integral hollow grommets each of which extends into an aperture in the frame section to act as a protective sleeve for a racket string or alternatively a plurality of separate hollow grommets may be provided each of which extends through an aperture in the bumper strip and an aligned aperture in the frame section. If the hollow grommets are separate from the bumper strip they may be formed integrally with a single grommet strip which may be adapted to lie within a continuous recess in the outer face of the bumper strip.

Preferably the grommets are made from a relatively hard synthetic plastics material such as nylon and the bumper strip is made from a relatively soft synthetic plastics material such as thermoplastics synthetic rubber.

Preferred forms of the invention are described below with reference to the accompanying drawings in which.

Figure 1:
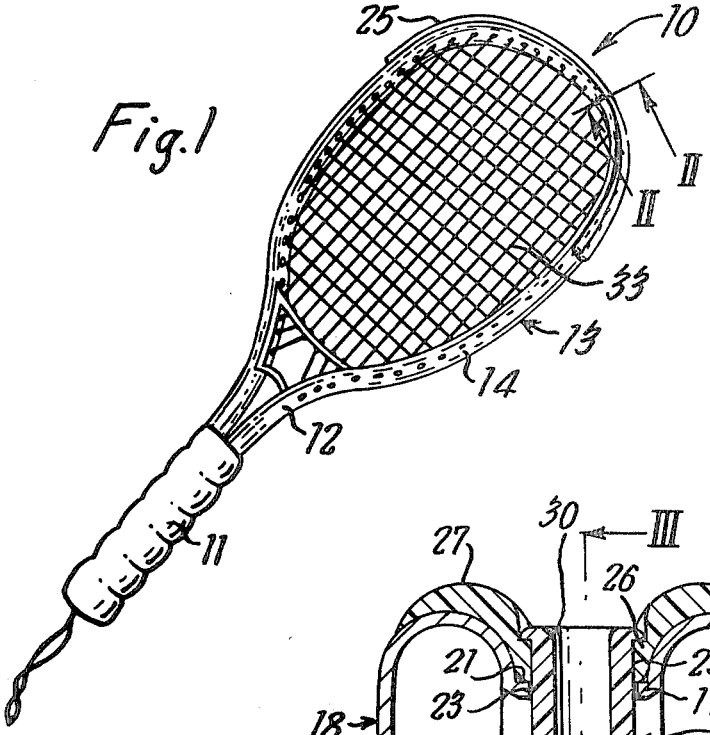
FIG. 1 is a perspective view of a stringed game racket.

In FIG. 1 a stringed games racket is indicated generally at 10. The racket 10 has the shape and dimensions of a racket ball racket and the invention will be described in relation to a racket ball racket. However it will be understood that the invention is applicable to any other stringed games racket such as a tennis racket or a squash racket. The present invention is particularly suitable and advantageous when used in combination with a metal racket but is applicable to rackets made of other materials such as wood, or glass or carbon reinforced plastics material.

The racket 10 comprises a handle 11, a shaft 12 and a head 13 which is formed by a continous frame section 14. The frame section 14 may be made from an aluminium extrusion or any other suitable metal or metal alloy.

Figure 2:
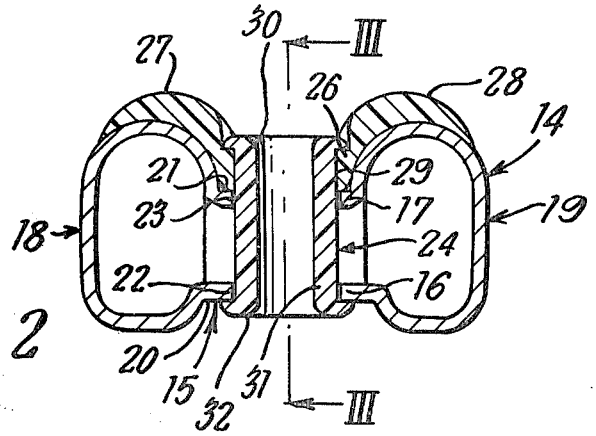
FIG. 2 is a section taken on the line II—II of FIG. 1.

The frame section 14 is shown in cross-section in FIG. 2 and comprises a hollow web 15 formed by parallel inner and outer walls 16 and 17 respectively which lie in planes normal to the plane of the racket face. The web walls 16 and 17 join two similar hollow side elements 18 and 19 respectively each of which is approximately oval in section and which define in combination with the inner and outer web walls continuous inner and outer channels 20 and 21 respectively. The channels 20 and 21 run around the circumference of the racket head. The web walls 16 and 17 are formed with rows of aligned generally radially extending, distinct, separate aperture means (apertures) 22 and 23 respectively which are adapted to receive grommets 24.

A protective bumper strip means (bumper strip) 25 is attached to the end of the frame section 14 with the aid of the grommets 24. The protective bumper strip 25 is formed from a relatively soft synthetic plastics material such as a thermoplastics synthetic rubber and comprises a web 26 and two outwardly projecting curved flanges 27 and 28 respectively. The web 26 is formed with a plurality of generally radially extending apertures 29 which are adapted to align with the apertures 22 and 23 and the inner surface of the strip 25 which is adapted to seat within the continuous outer channel 21 is complementary with the outer surface of the frame section 14 which is defined by the outer channel 21 and the side elements 18 and 19. Thus when the protective bumper strip 25 is located in the outer channel 21 it will fit snugly within the channel with the flanges 27 and 28 overlying the outer faces of the side elements 18 and 19 thereby substantially protecting the whole of the width of the outer face of the frame section 14.

The protective bumper strip 25 extends around a substantial part of the circumference of the end portion of the racket head 13 and is located in position by the grommets 24 which extend through the apertures 29 in the strip 25 and the apertures 22 and 23 in the web 15 of the frame section 14. Each grommet is formed from a substantially harder synthetic plastics material than the strip 25, for instance from a nylon material, and each grommet comprises a head 30 which locates on the outer surface of the web of the strip 25 and a hollow shank 31 which extends through the strip 25 and through the web 15 of the frame section 14. The inner end of each grommet which projects through the web 15 is turned to form a tail 32 which retains the grommet in position thereby attaching the strip 25 to the frame section 14. The tail 32 can be turned by cold or hot forming.

When the protective bumper strip 25 has been attached to the frame section 14 by the grommets 24, the racket can then be strung in a conventional manner with each string 33 passing outwardly through one grommet and then reversely through the next adjacent grommet on the frame section. Thus once the racket has been strung the protective bumper strip 25 is securely attached to the frame section 14 and will withstand any impact or glancing blow on the head of the racket.

It will be seen that the flanges 27 and 28 of the protective bumper strip 25 extend outwardly across substantially the whole of the width of the outer face of the frame section thus protecting the frame section from any direct or glancing blow as a result of the end of the head of the racket striking a wall or the floor. It will also be seen that the protective bumper strip 25 extends around a substantial part of the end of the head of the racket. The protective bumper strip 25 is preferably formed with a relatively soft synthetic plastics material such as a thermoplastics synthetic rubber while the grommets 24 are formed from a harder synthetic plastics material such as nylon. The grommets thus protect the strings 33 from chafing against the metal frame section 14.

The shape of the protective bumper strip 25 is such that it is formed with an external continuous recess to receive the grommet heads 30 and the exposed portions of the strings 33, thereby protecting the exposed protions of the strings from damage and from inflicting damage on other objects.

It will be appreciated that both the length and width of the protective bumper strip 25 may be varied, for instance so that the flanges 27 and 28 wrap completely around the side elements 18 and 19 and it is also envisaged that the shape of the protective strip may be varied to suit any particular form of frame section. For instance, if the outer face of the frame section of the racket is substantially flat then the inner face of the protective bumper strip will be flat so as to complement the outer face of the frame section. In this event it is desirable for the outer face of the protective bumper strip to be formed with a continuous recess or channel to house the grommet heads and the exposed portions of the racket strings.

Figure 3:
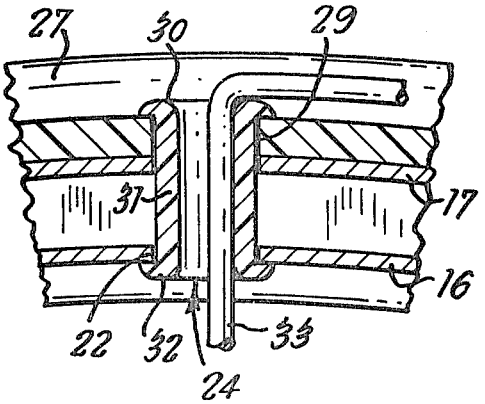
FIG. 3 is a section taken on the line III—III of FIG. 2.
Figure 4:
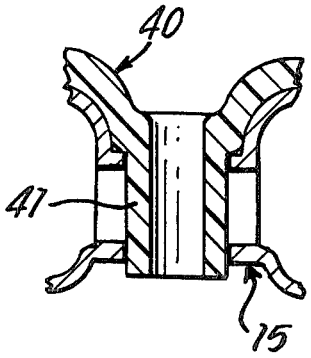
FIG. 4 is a section similar to FIG. 2 illustrating a modification of the racket frame shown in FIGS. 1 to 3.

It is also envisaged that the protective strip of the present invention may be modified so as to eliminate the necessity for grommets in the region of the protective strip. Such a modification is shown in FIG. 4 which illustrates a protective strip 40 formed with a plurality of integrally moulded hollow grommets 41 each of which extends through the aligned apertures in the web 15 of the frame section 14. The end of each grommet 41 which projects through the web 15 may be turned in the same manner as the grommets 24 shown in FIGS. 1 to 3 or alternatively may be unturned, in which event the protective strip 40 will be secured to the frame section 14 solely by the strings 33 of the racket.

Figure 5:
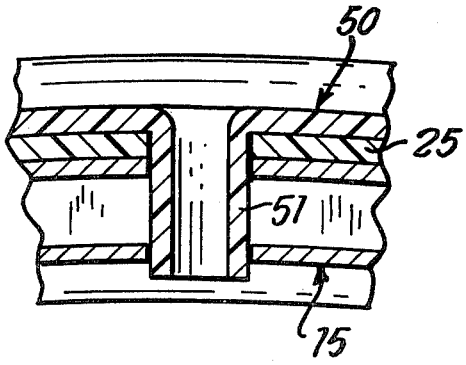
FIG. 5 is a section similar to FIG. 3 showing a further modification of the racket frame section shown in FIGS. 1 to 3.

It is further envisaged that in another modification of the invention the grommets which project through the protective bumper strip 25 may be formed integrally with a continuous grommet strip so as to be mountable as a unit on the protective strip. Such a modification of the invention is shown in FIG. 5 which illustrates a grommet strip 50 having a plurality of integral hollow grommets 51 each of which is located and shaped to project through the apertures in the protective bumper strip 25 and the web 15 of the frame section 14 when the strip 50 is laid within the continuous recess in the outer face of the protective bumper strip 25. The projecing ends of the grommets 51 may also be turned to secure the grommet strip 50 and the protective bumper strip 25 to the frame section 14 or alternatively may be left as shown in FIG. 5 so that the grommet strip and protective bumper strip are secured to the frame section solely by the strings of the racket.

Other modifications and changes may be made to the shape and dimensions of the protective strip and the grommets without departing from the spirit and scope of the present invention which is more clearly defined in the following claims.

What I claim is:

1. A games racket comprising a shaft and a head formed by a frame section, said frame section having a plurality of distinct, separate, generally radially extending aperture means for receiving strings of the racket therein; and said frame section having an outer face; and protective bumper strip means for providing surface to surface contact with said frame section over a portion thereof so that said means acts as a protective bumper for said frame section, said bumper strip means comprising an inner face which conforms generally to the shape of at least a substantial part of the width of the outer face of said frame section, and including a plurality of generally radially extending, distinct, separate apertures therein aligned with said aperture means in said frame section for receipt of racket strings therein.

2. A games racket as claimed in claim 1 in which the bumper strip means is formed with a plurality of integral hollow grommets each of which extends into an aperture means of the frame section to act as a protective sleeve for a racket string.

3. A games racket as claimed in claim 1 in which a plurality of hollow grommets are provided each of which extends through an aperture in the bumper strip means and an aligned aperture means in the frame section to act as a protective sleeve for a racket string.

4. A games racket as claimed in claim 3 in which the grommets are formed from a substantially harder material than the protective bumper strip.

5. A games racket as claimed in claim 4 in which the grommets are formed from nylon and the bumper strip is formed from a thermoplastics synthetic rubber.

6. A games racket as claimed in claim 3 in which the hollow grommets are formed integrally as part of a grommet strip.

7. A games racket as claimed in claim 1 in which the outer face of the frame section is formed with a continuous channel bounded by two side walls and the bumper strip means is formed with a web adapted to seat in and complement the channel and two side flanges adapted to overlie and protect a substantial part of the width of the outer surfaces of the side walls.

8. A games racket as claimed in claim 7 in which the outer face of the bumper strip means is formed with a continuous recess.

9. A games racket as claimed in claim 8 in which the bumper strip means is formed with a plurality of integral hollow grommets each of which extends into an aperture means of the frame section to act as a protective sleeve for a racket string.

10. A games racket as claimed in claim 8 in which a plurality of hollow grommets are provided each of which extends through an aperture in the bumper strip means and an aligned aperture means in the frame section to act as a protective sleeve for a racket string.

11. A games racket as claimed in claim 10 in which the grommets are formed from a substantially harder material than the protective bumper strip.

12. A games racket as claimed in claim 11 in which the grommets are formed from nylon and the bumper strip is formed from a thermoplastics synthetic rubber.

13. A games racket as claimed in claim 10 in which the hollow grommets are formed integrally as part of a grommet strip.

14. A games racket as claimed in claim 11 in which the grommets are made from a substantially harder synthetic plastics material than the bumper strip.

15. A games racket as claimed in claim 14 in which the bumper strip means is formed with an outer surface having a continuous recess and the grommets are formed with heads located in the recess in the bumper strip means.

16. A games racket as claimed in claim 12 in which each grommet has a portion which extends through the frame section and which is deformed to resist withdrawal from the frame section.

17. A games racket comprising a shaft and a head formed by a frame section, said frame section having a plurality of distinct, separate, generally radially extending aperture means for receiving strings of the racket therein; and said frame section having an outer face;

protective bumper strip means for providing surface to surface contact with said frame section and for the protection thereof, and comprising an inner face which conforms generally to the shape of at least a substantial part of the width of the outer face of the frame section, and including a plurality of generally radially extending, distinct, separate apertures therein aligned with said aperture means in said frame section;

a plurality of grommets each of which extends through a said aperture means in said frame section; and racket strings extending through said grommets for securing said bumper strip to said frame section.

18. A games racket as claimed in claim 17 in which the bumper strip means extends over a substantial part of the circumference of the frame section.

* * * * *